US006287038B1

(12) United States Patent
Chan

(10) Patent No.: US 6,287,038 B1
(45) Date of Patent: Sep. 11, 2001

(54) RING BINDER

(75) Inventor: Keung Chan, An Qing (CN)

(73) Assignee: Leco Stationery Manufacturing Company Limited, New Territories (HK)

( * ) Notice: Subject to any disclaimer, the term of this patent is extended or adjusted under 35 U.S.C. 154(b) by 0 days.

(21) Appl. No.: 09/620,131

(22) Filed: Jul. 20, 2000

(51) Int. Cl.[7] ..... B42F 13/00

(52) U.S. Cl. ..... 402/73; 402/4; 402/70; 281/37

(58) Field of Search ..... 206/308.3, 308.5; 402/80 P, 73, 4; 281/37, 31

(56) References Cited

U.S. PATENT DOCUMENTS 1,585,846 * 5/1926 Frisbie ..... 281/37 X
4,518,275 * 5/1985 Rauch, III et al. ..... 402/80 P
5,501,540 * 3/1996 Ho ..... 402/73
5,913,420 * 6/1999 Morita ..... 206/308.3

* cited by examiner

*Primary Examiner*—Willmon Fridie, Jr.
(74) *Attorney, Agent, or Firm*—Hall, Priddy, Myers & Vande Sande

(57) ABSTRACT

There is disclosed a ring binder (100) including a ring binder mechanism (106) secured to a cover, wherein the ring binder mechanism (106) includes a pair of pivoting plates to which half-rings (112) are mounted, and the pivoting plates are movable between a first configuration in which the half-rings (112) are open, and a second configuration in which the half-rings (112) are closed, and the ring binder (100) includes a holder (114, 202) for releasably engaging with a compact disk (210).

7 Claims, 10 Drawing Sheets

RING BINDER

This invention relates to a ring binder, and in particular a ring binder with mechanism for releasably holding a compact disk.

BACKGROUND OF THE INVENTION

There are in existence a large variety of ring binders which allow retention and retrieval of loose-leaf sheets. While it is well known to record information and data on paper, with the advancement of technology, much information and data can be and are now stored in and retrieved from compact disks, whether such be audio compact disks, video compact disks or digital video disks. However, existing ring binders do not cater for this technological advancement, and users of such ring binders have to find ways to store the compact disks, which may contain information and data which are relevant to those stored in the loose-leaf sheets retained by the ring binders.

It is thus an object of the present invention to provide a ring binder in which the aforesaid shortcoming is mitigated, or at least to provide a useful alternative to the public.

SUMMARY OF THE INVENTION

According to a first aspect of the present invention, there is provided a ring binder including a ring binder mechanism secured to a base member, wherein said ring binder mechanism includes a pivotable structure to which a plurality of half-ring members are mounted, wherein said pivotable structure is movable between a first configuration in which said half-ring members are open, and a second configuration in which said half-ring members are closed, wherein said ring binder includes at least one holder adapted to be releasably engaged with a compact disk, wherein said holder is fixedly secured to said base member and wherein said holder includes a plurality of securing members penetrable into said base member to fixedly secure said holder to said base member.

According to a second aspect of the present invention, there is provided a ring binder including a ring binder mechanism secured to a base member, wherein said ring binder mechanism includes a pivotable structure to which a plurality of half-ring members are mounted, wherein said pivotable structure is movable between a first configuration in which said half-ring members are open, and a second configuration in which said half-ring members are closed, wherein said ring binder includes at least one holder adapted to be releasably engaged with a compact disk, wherein said holder is movable relative to said base member, wherein said holder is fixedly secured to a board member, and wherein said board member includes at least an aperture allowing a half-ring member to extend therethrough.

BRIEF DESCRIPTION OF THE DRAWINGS

Embodiments of ring binder in accordance with the present invention will now be described, with examples only, and with reference to the accompanying drawings, in which.

DETAILED DESCRIPTION OF THE PREFERRED EMBODIMENTS

Figure 1:
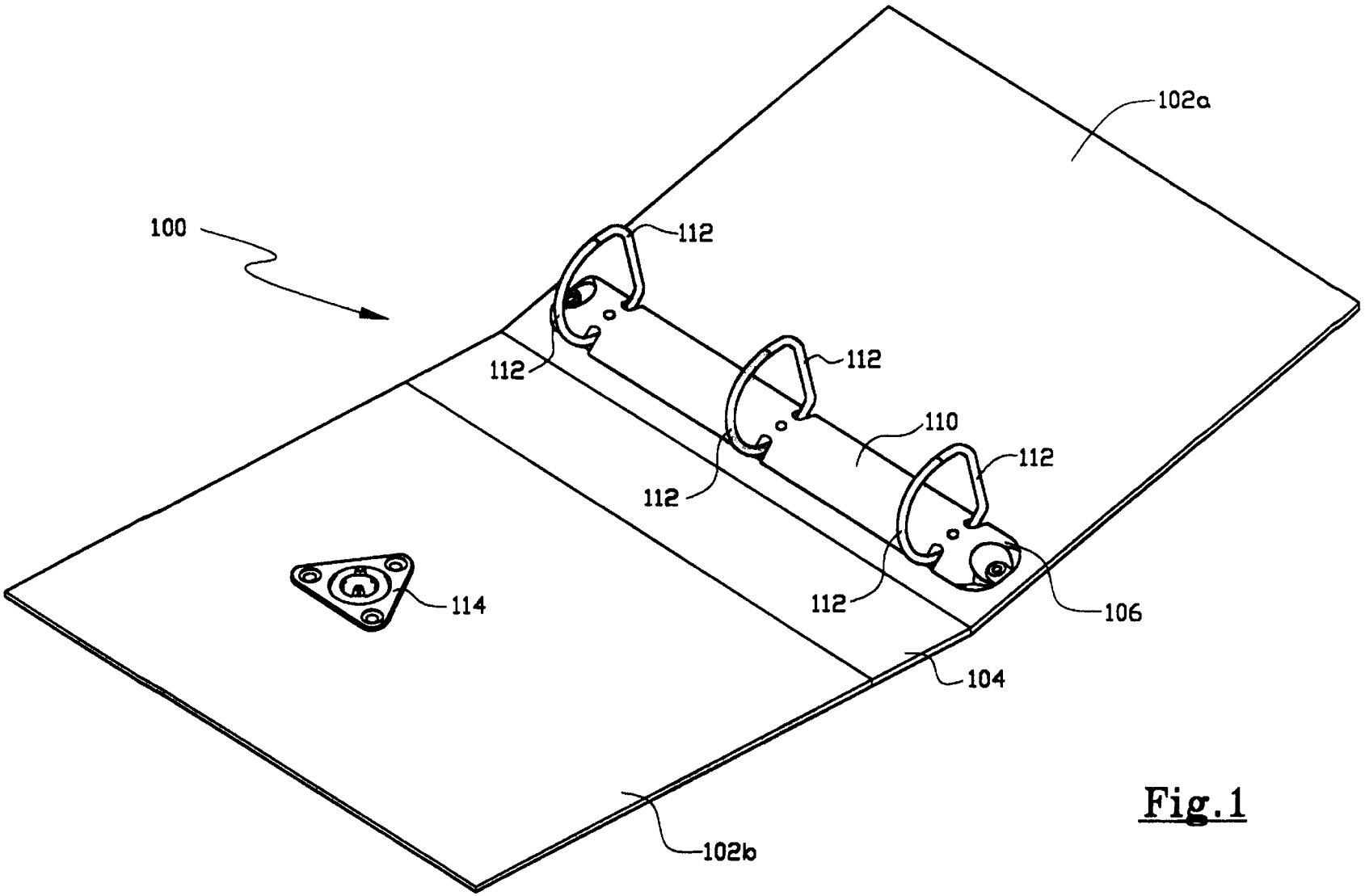
FIG. 1 is a perspective view of a first embodiment of a ring binder, with a first type of compact disk holder, according to the present invention.
Figure 2:
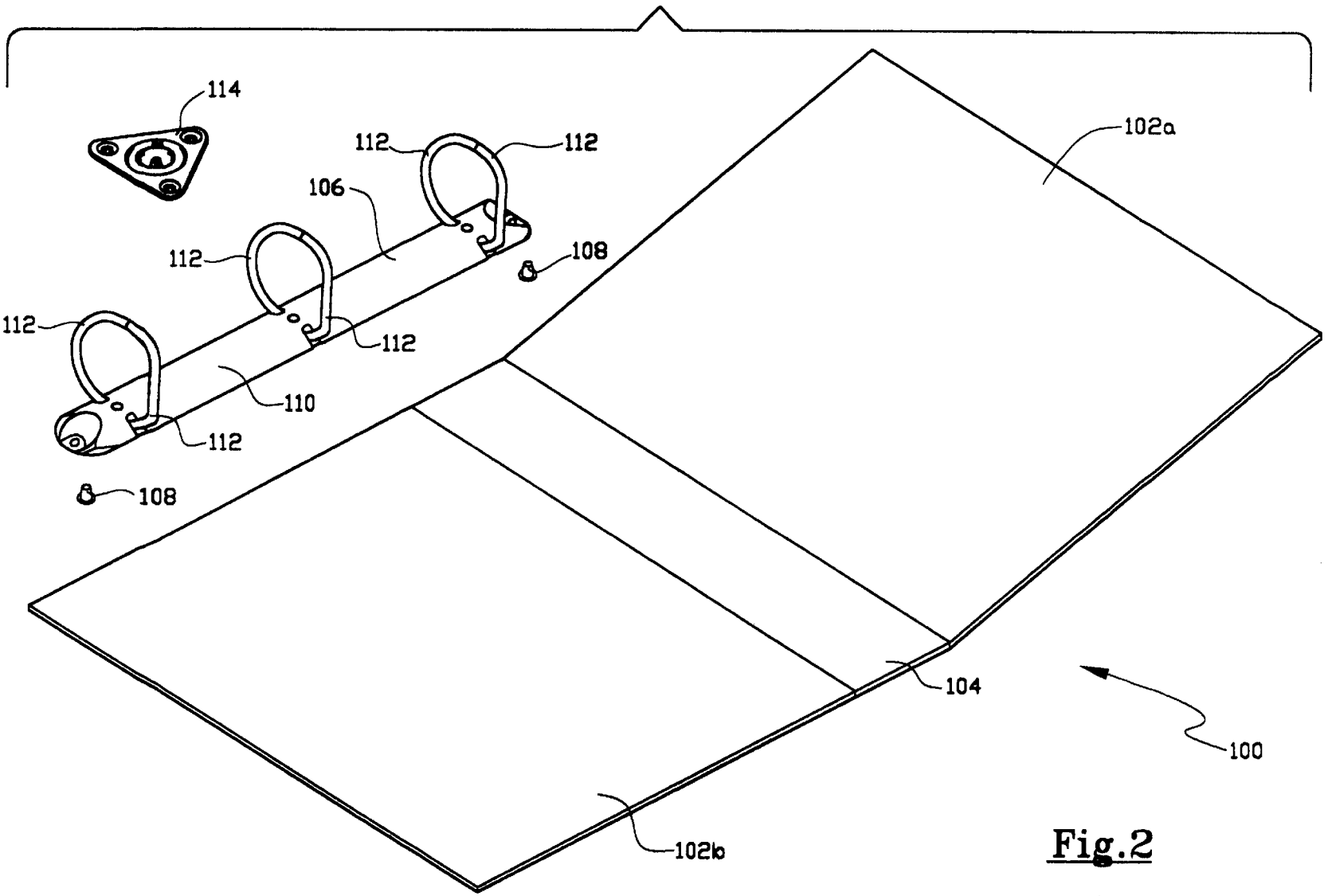
FIG. 2 is an exploded view of the ring binder in FIG. 1.
Figure 3:
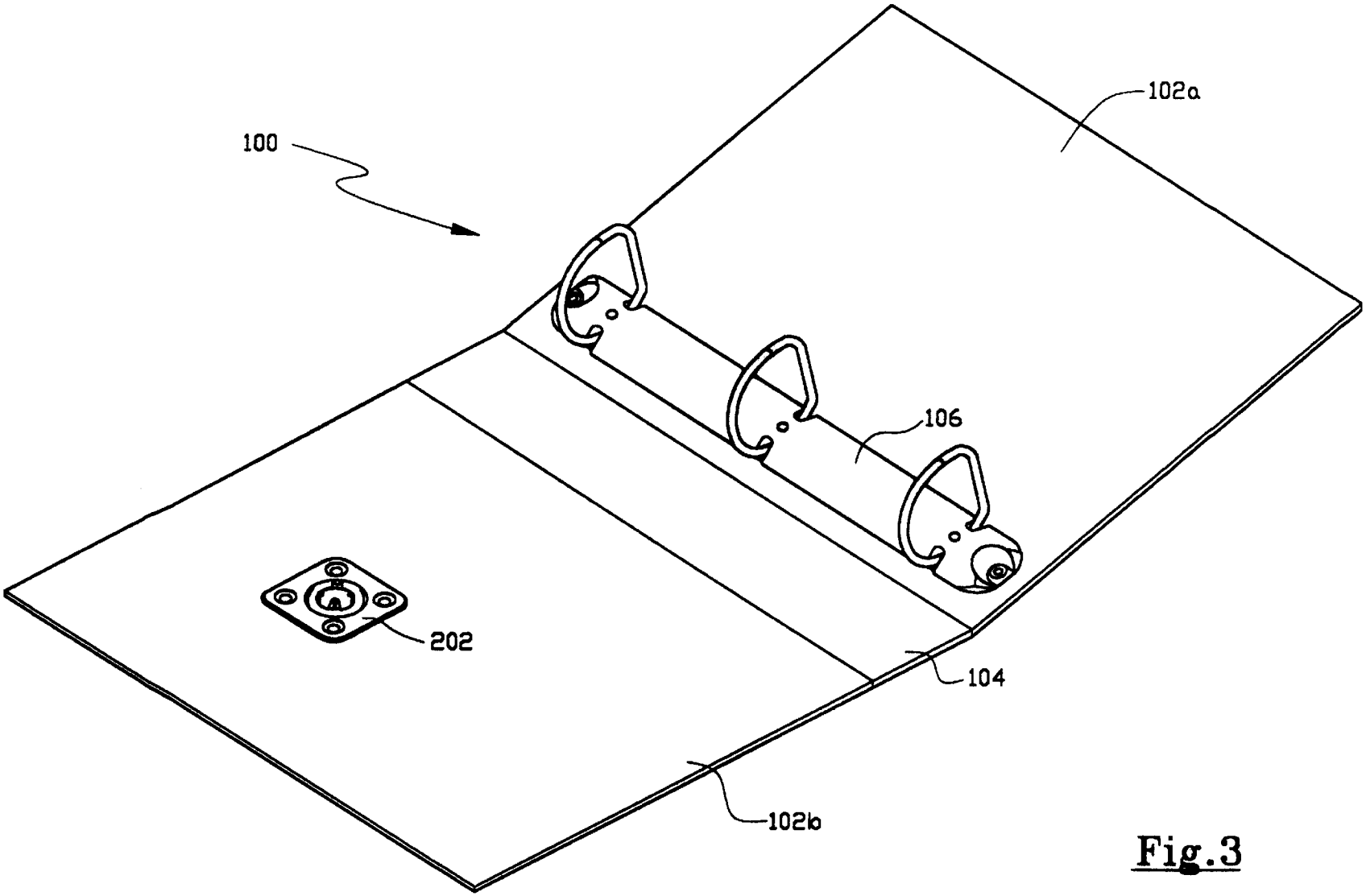
FIG. 3 is a perspective view of the first embodiment of ring binder shown in FIG. 1 with a second type of compact disk holder.
Figure 4:
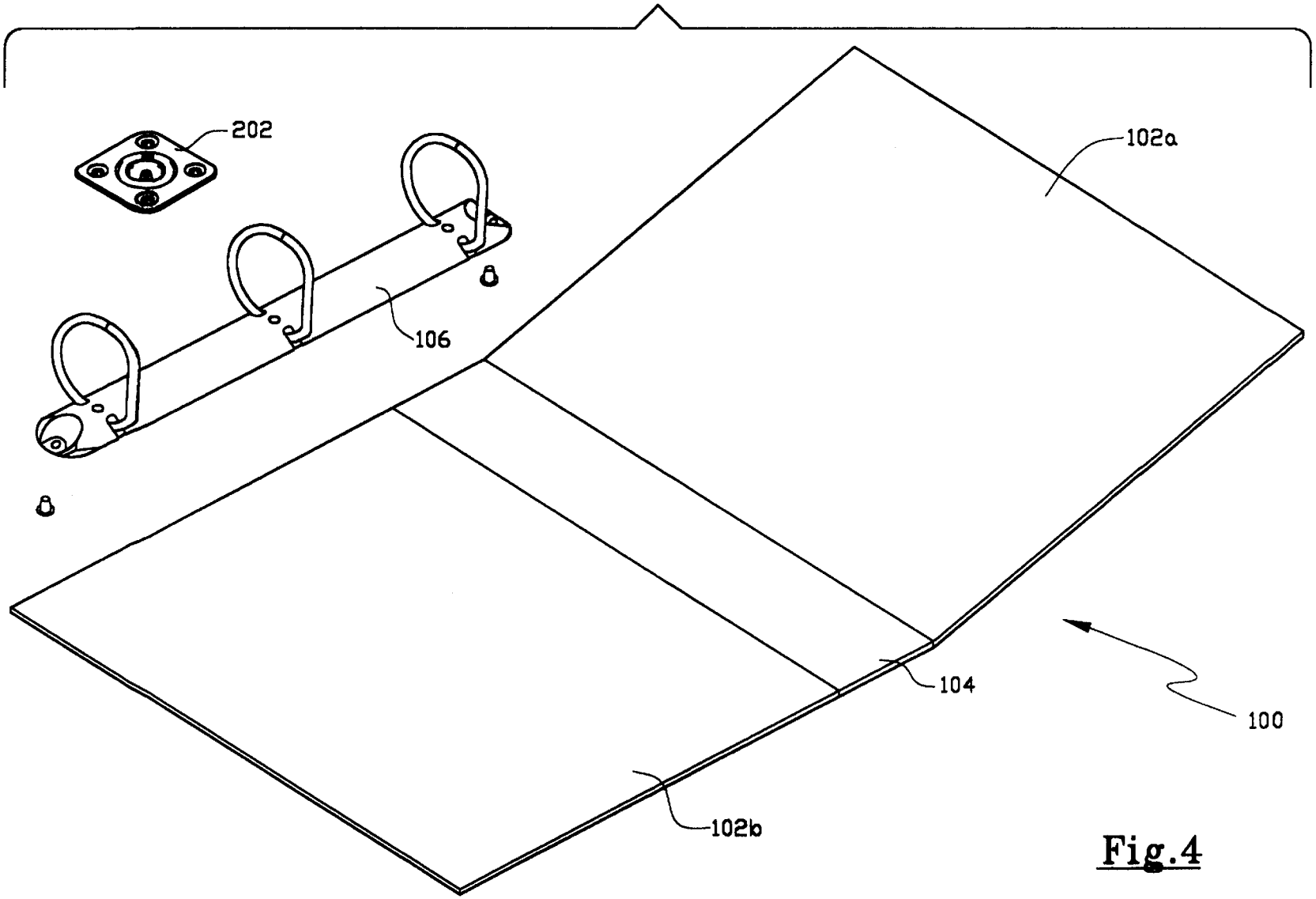
FIG. 4 is an exploded view of the ring binder shown in FIG. 3.

FIGS. 1 and 2 collectively show a first ring binder according to the present invention, and generally designated as 100. The ring binder 100 includes two side covers 102*a*, 102*b* joined by a central spine portion 104. To the side cover 102*a* is fixedly secured a ring binder mechanism 106 via two rivets 108. The ring binder mechanism 106 includes a curved substantially rigid upper plate 110 supporting a pair of pivoting plates (not shown). To each of the plates are fixedly secured three half rings 112, which may be caused to open or close upon pivoting of the pivoting plates, so that loose-leaf sheets may be retained by or retrieved from the ring binder 100. To the side cover 102*b* is fixedly engaged a compact disk (CD) holder 114, details of which will be discussed below. In this connection, the term "compact disk" here includes CD-ROM, video compact disk and digital video disk. By way of such an arrangement, one or more compact disk may be releasably engaged with the ring binder 100. In FIGS. 3 and 4, the ring binder 100 is shown as secured with a different compact disk holder 202.

Figure 5B:
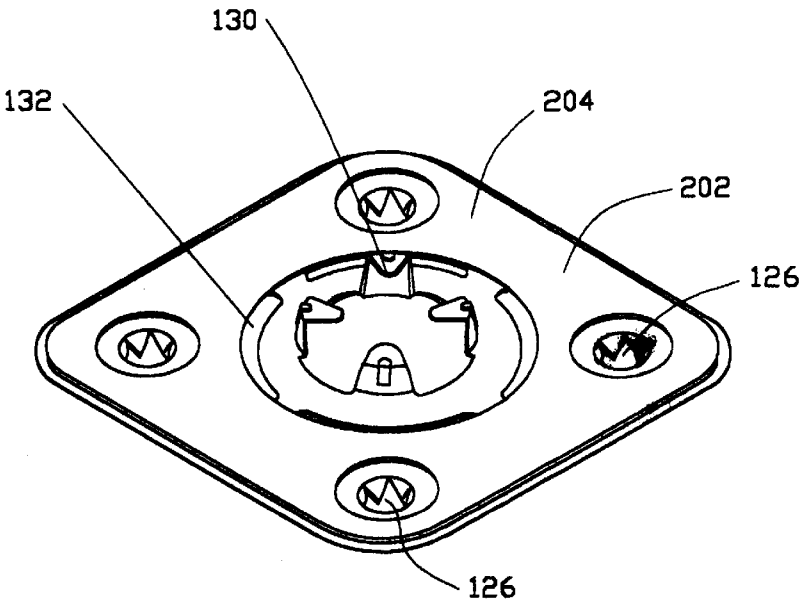
FIG. 5B is a top perspective view of the second compact disk holder shown in FIG. 3.
Figure 5A:
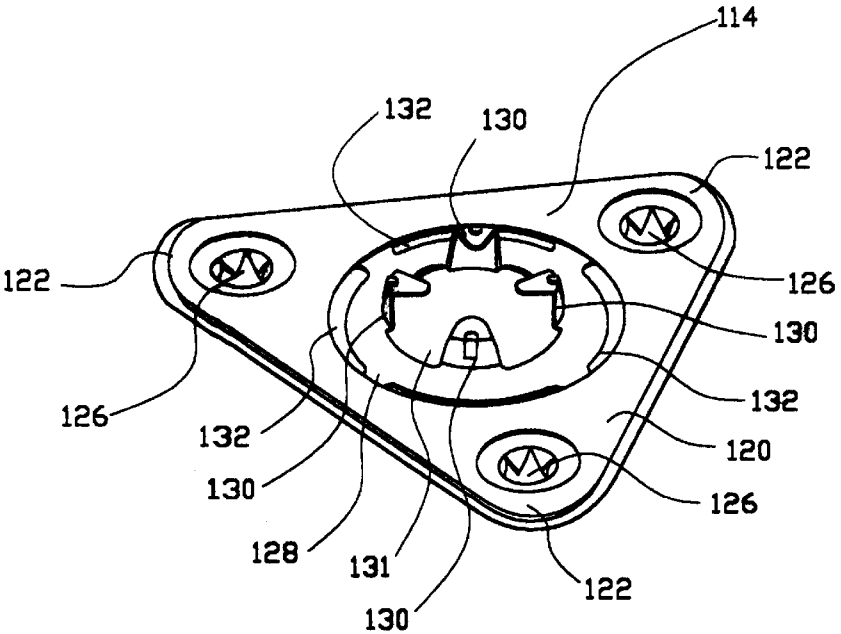
FIG. 5A is a top perspective view of the first type of compact disk holder shown in FIG. 1.
Figure 6B:
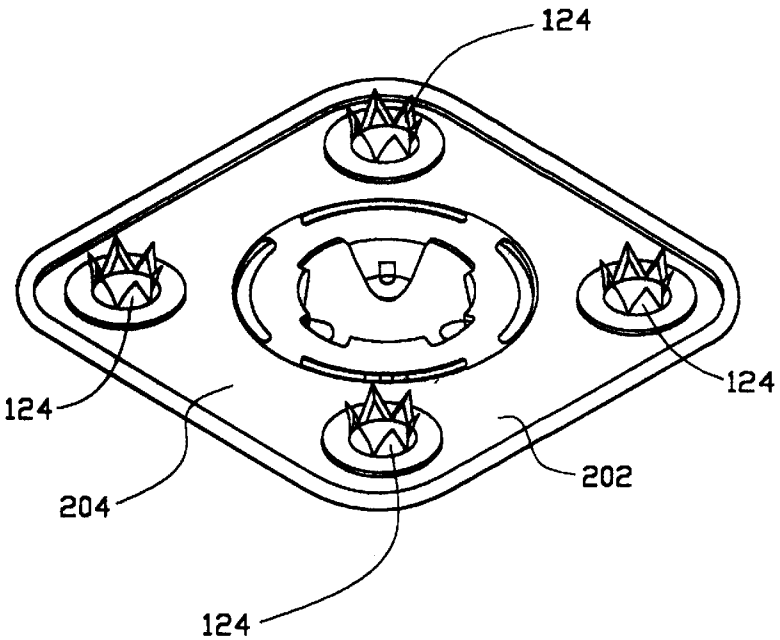
FIG. 6B is a bottom perspective view of the second type of compact disk holder shown in FIG. 6A.
Figure 6A:
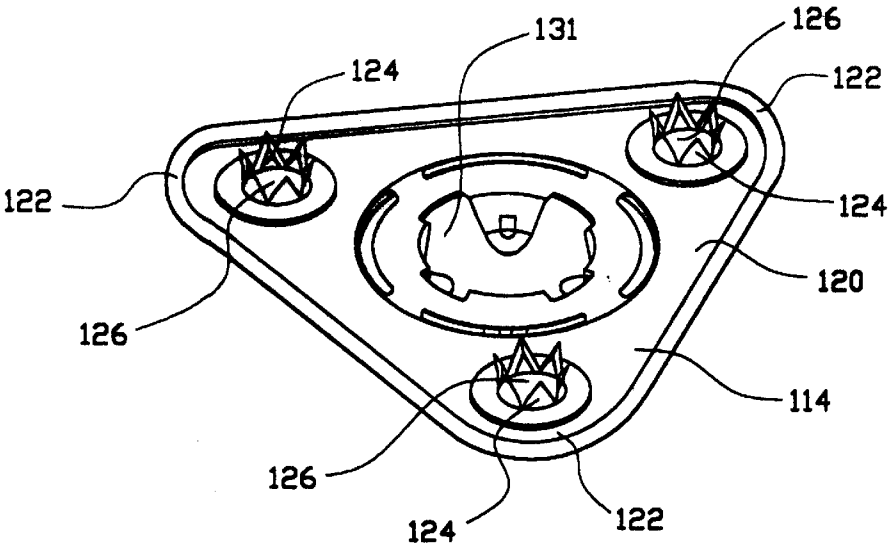
FIG. 6A is a bottom perspective view of the first type of compact disk holder shown in FIG. 5A.

Referring to the compact disk holder 114 shown in FIGS. 5A and 6A, such includes a generally triangular plate 120 with rounded corners 122. The disk holder 114 is made of steel. Adjacent to each comer 122 are a set of claws 124 which extend downwardly from the undersurface of the plate 120. Each claw 124 of the same set also extends generally away from the longitudinal axis of a respective circular aperture 126. Provided in the central area of the compact disk holder 114 is a compact disk retaining mechanism 128 with four resilient fingers 130 which extend generally upwardly from the upper surface of the plate 120 and uniformly around a central hole 131. The disk holder 114 also includes four curved slots 132 uniformly distributed around the central hole 131, each adjacent to or near a respective finger 130. The fingers 130 are nearer to the central hole 131 than are the slots 132 to the central hole 131. By way of such an arrangement, the fingers 130 may be moved to retain the compact disk, or to allow the compact disk to be retrieved, in a manner to be discussed below.

As to the compact disk holder 202 shown in FIGS. 5B and 6B, its main differences with the compact disk holder 114 shown in FIGS. 5A and 6A are that its plate 204 is generally square in shape, and that there are four sets of claws 124. It should in fact be understood that the plate of the compact disk holder can be of different shapes.

Figures 7A, 7B, 7C:
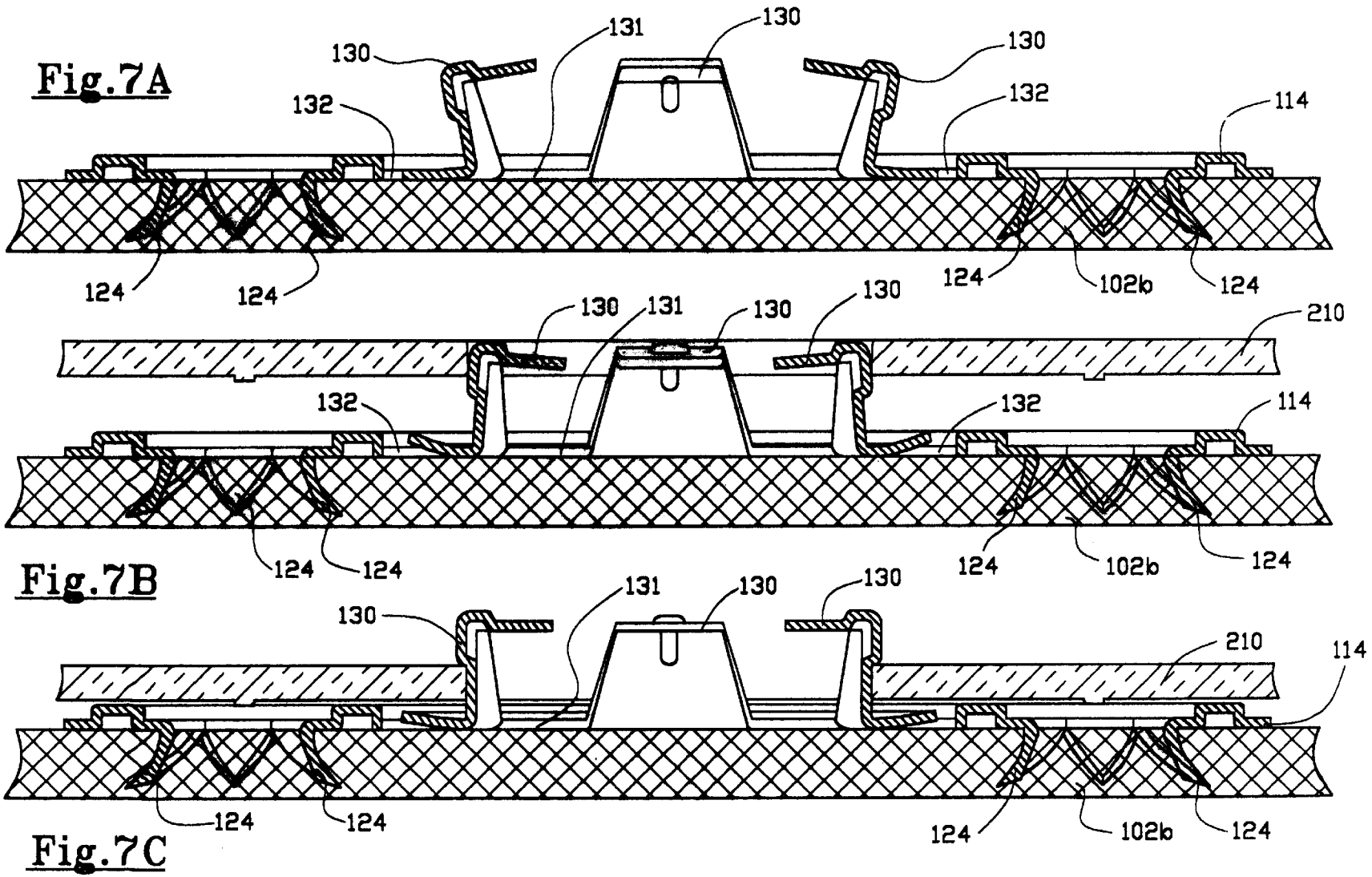
FIGS. 7A to 7C show the manner in which a compact disk is engaged with or disengaged from the compact disk holder according to the present invention.

FIGS. 7A to 7C show the manner in which a compact disk 210 may be engaged with or disengaged from the compact disk holder 114, although it should be understood that the same principle applies in respect of the compact disk holder 202. It can be seen in FIG. 7A that the claws 124 of the compact disk holder 114 penetrate into the side cover 102*b*, so that the compact disk holder 114 is fixedly secured to the side cover 102*b*. This engagement between the compact disk holder 114 and the side cover 102*b* is enhanced by the fact that the claws 124 extend away from the aperture 126, which act against attempts of disengagement. In this situation, the fingers 130 extend slightly away from the longitudinal axis of the hole 131. When the compact disk 210 is pushed onto the compact disk holder 114 (as shown in FIG. 7B), the fingers 130 are caused to bend slightly inwardly (which is allowed by the existence of the curved slots 132) to allow movement of the compact disk 210 therethrough, until the compact disk 210 reaches the position shown in FIG. 7C, in which it is engaged with the compact disk holder 114. The engagement between the compact disk 210 and the compact disk holder 114 is thus in a snap-fit manner.

If the compact disk 210 is to be disengaged from the holder 114, a user has to act on the fingers 130 to bend them slightly inwardly to the position shown in FIG. 7B, whereupon the disk 210 may be disengaged from the holder 210.

Figure 8A:
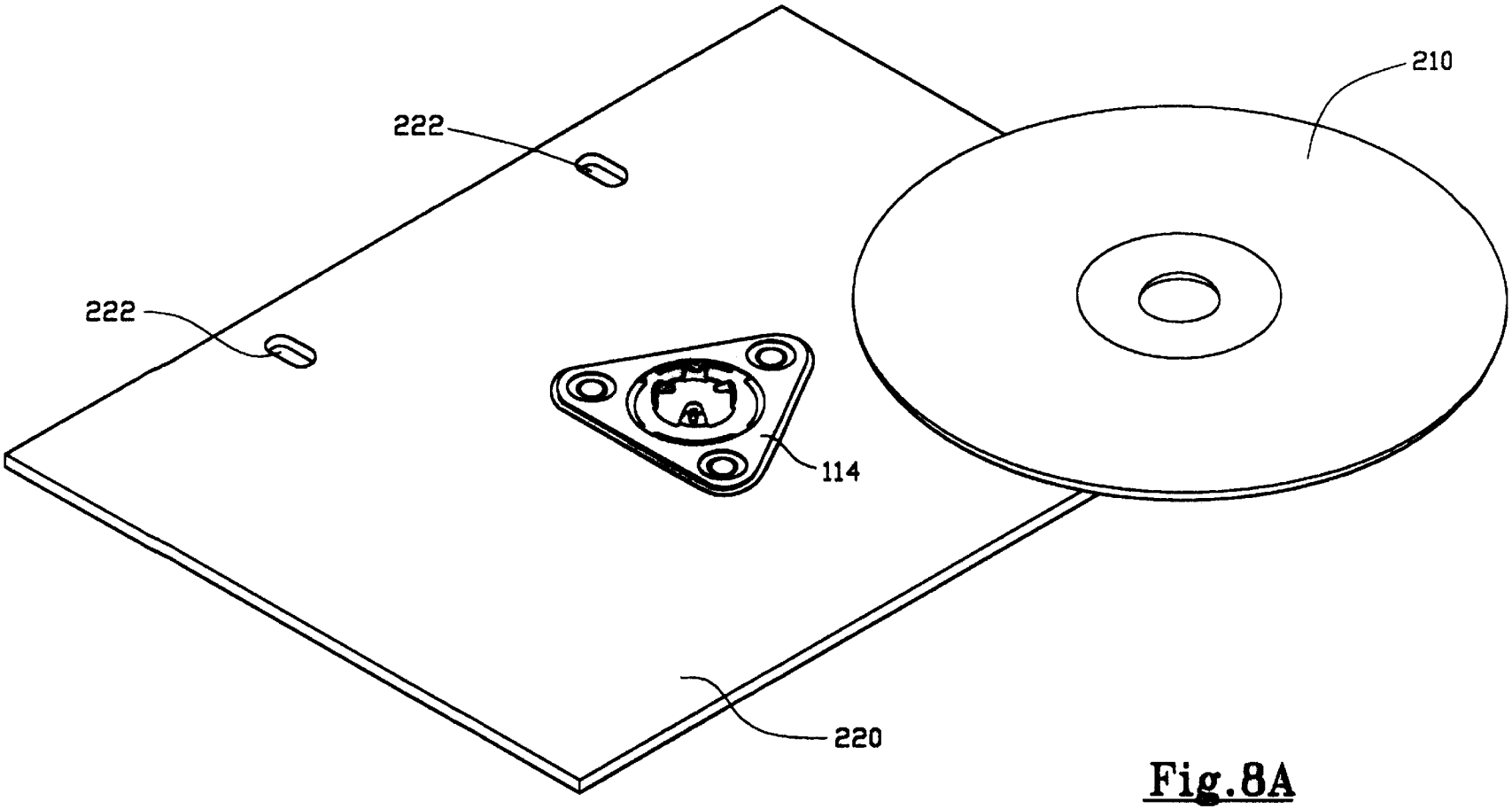
FIG. 8A is a perspective view of the first type of compact disk holder shown in FIG. 5A as secured to a cardboard, forming part of a third embodiment of a ring binder according to the present invention.
Figure 8B:
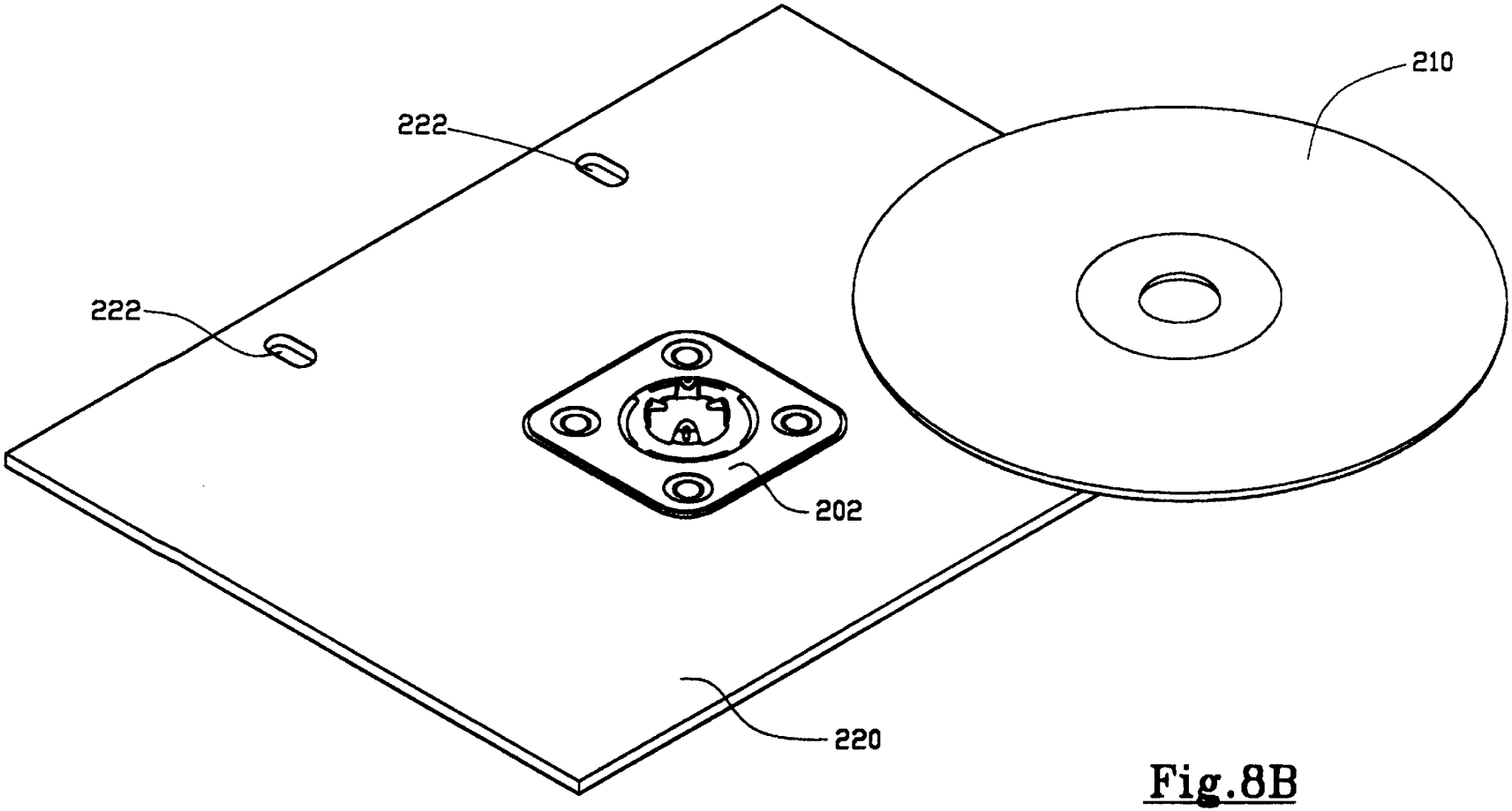
FIG. 8B is a perspective view of the second type of compact disk holder shown in FIG. 5B as secured to a cardboard, forming part of the third embodiment of ring binder according to the present invention.
Figure 8C:
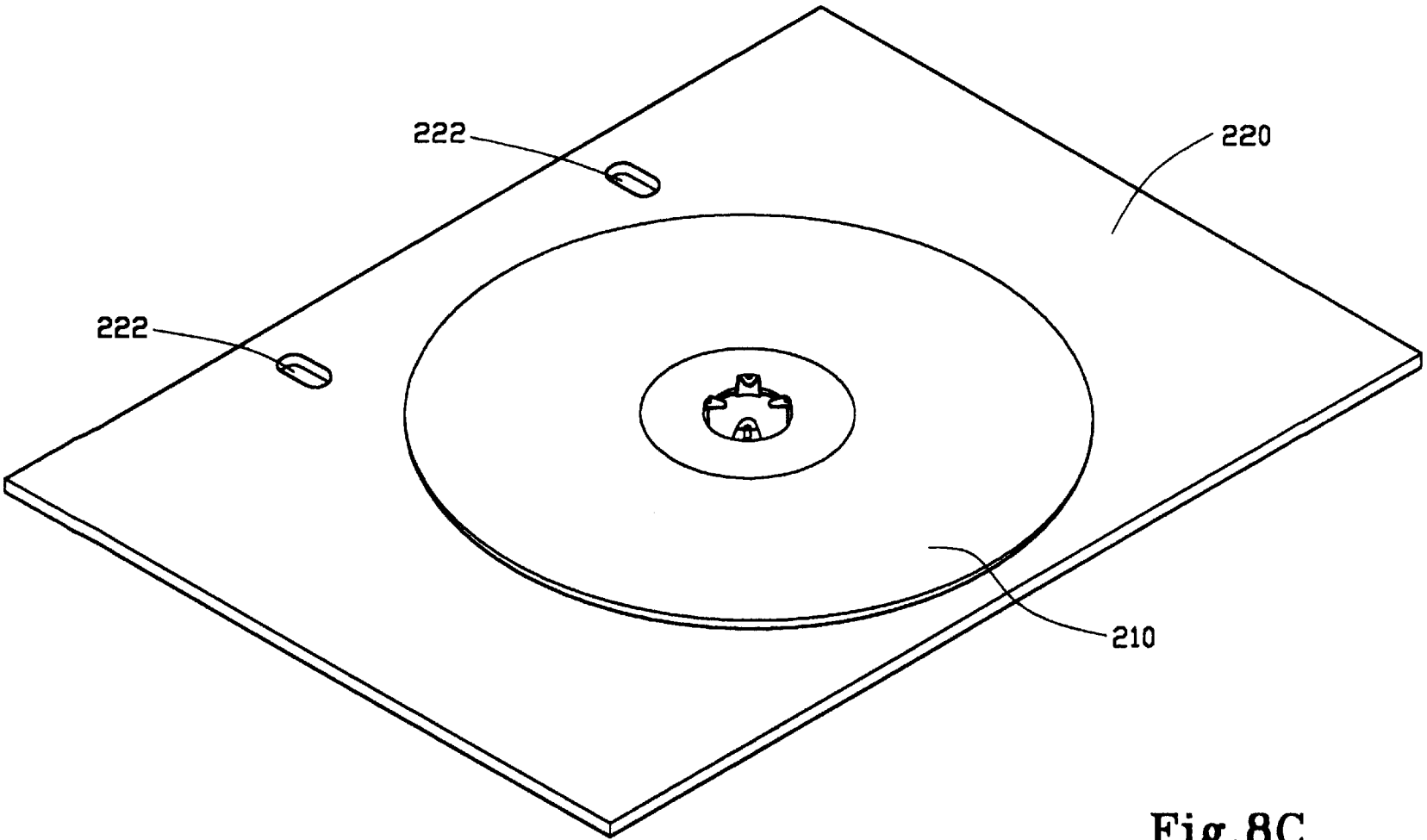
FIG. 8C is a perspective view showing a compact disk as engaged with the third embodiment of ring binder according to the present invention, as shown in FIG. 8A or 8B.

As an alternative embodiment, the compact disk holder 114 (as shown in FIG. 8A) or 202 (as shown in FIG. 8B), may be fixedly secured to a rectangular cardboard 220, as shown in FIG. 8C. The cardboard 220 includes two openings 222, which are positioned, sized and configured to allow the half-rings 112 to extend through, e.g. one of each of the two outermost half-ring pairs 112 extend through a respective opening 222, so that the cardboard may be retained by the ring binder mechanism 106, and movable relative to it. This allows the compact disk 210 to be stored among other loose-leaf sheets, according to the purpose of the user.

What is claimed is:

1. A ring binder including a ring binder mechanism secured to a base member, wherein said ring binder mechanism includes a pivotable structure to which a plurality of half-ring members are mounted, wherein said pivotable structure is movable between a first configuration in which said half-ring members are open, and a second configuration in which said half-ring members are closed, wherein said ring binder includes at least one holder adapted to be releasably engaged with a compact disk, wherein said holder is fixedly secured to said base member and wherein said holder includes a plurality of securing members penetrable into said base member to fixedly secure said holder to said base member.

2. A ring binder according to claim 1 wherein said holder includes a substantially triangular plate member.

3. A ring binder according to claim 1 wherein said holder includes a substantially rectangular plate member.

4. A ring binder according to claim 1 wherein said securing members depend from a plate member of said holder.

5. A ring binder according to claim 4 wherein said securing members are integral with said plate member.

6. A ring binder including a ring binder mechanism secured to a base member, wherein said ring binder mechanism includes a pivotable structure to which a plurality of half-ring members are mounted, wherein said pivotable structure is movable between a first configuration in which said half-ring members are open, and a second configuration in which said half-ring members are closed, wherein said ring binder includes at least one holder adapted to be releasably engaged with a compact disk, wherein said holder is movable relative to said base member, wherein said holder is fixedly secured to a board member, and wherein said board member includes at least an aperture allowing a half-ring member to extend therethrough.

7. A ring binder according to claim 6 wherein said board member includes two apertures, each allowing one of said half-ring members to extend therethrough.

* * * * *